US010843064B1

(12) United States Patent
Rivera

(10) Patent No.: US 10,843,064 B1
(45) Date of Patent: Nov. 24, 2020

(54) SOCCER BOARD GAME ASSEMBLY

(71) Applicant: Gerardo Rivera, Fontana, CA (US)

(72) Inventor: Gerardo Rivera, Fontana, CA (US)

( * ) Notice: Subject to any disclaimer, the term of this patent is extended or adjusted under 35 U.S.C. 154(b) by 0 days.

(21) Appl. No.: 16/670,300

(22) Filed: Oct. 31, 2019

(51) Int. Cl.
*A63F 7/00* (2006.01)
*A63F 3/00* (2006.01)
*A63F 7/30* (2006.01)

(52) U.S. Cl.
CPC ..... *A63F 3/00041* (2013.01); *A63F 3/00261* (2013.01); *A63F 7/305* (2013.01); *A63F 2003/00466* (2013.01); *A63F 2003/00514* (2013.01)

(58) Field of Classification Search
CPC .. A63F 3/00041; A63F 3/00261; A63F 7/305; A63F 2003/00514; A63F 2003/00466
USPC ..... 273/148 A, 150, 247
See application file for complete search history.

(56) References Cited

U.S. PATENT DOCUMENTS 2,492,423 A * 12/1949 Gray ..... A63F 7/068 273/129 R
3,495,827 A * 2/1970 Ledezzma ..... A63F 7/0684 273/108.53
4,136,871 A 1/1979 Meyers
4,173,338 A * 11/1979 Barnett ..... A63F 7/3065 273/108.1
4,257,599 A 3/1981 Cutri
5,431,397 A * 7/1995 Eckel ..... A63F 7/0668 273/108.1
5,472,198 A * 12/1995 Alvarez ..... A63F 1/10 273/150
7,147,225 B2 * 12/2006 Navarro ..... A63F 7/06 273/242
7,325,803 B1 * 2/2008 Miranda ..... A63F 7/0668 273/108.41
D739,469 S 9/2015 Smith
2002/0125633 A1 9/2002 Mashkabov
2005/0023756 A1 2/2005 Fouty
2007/0021241 A1 * 1/2007 Geller ..... A63B 63/004 473/415
2014/0167354 A1 * 6/2014 Wu ..... A63F 3/00041 273/247
2016/0107077 A1 4/2016 Kuroiwa

FOREIGN PATENT DOCUMENTS

EP 2485817 B1 * 4/2014 ..... A63F 7/068
WO WO2017115213 7/2017

* cited by examiner

*Primary Examiner* — Vishu K Mendiratta

(57) ABSTRACT

A soccer board game assembly for playing a soccer themed game includes a panel that is representative of a soccer field. Each of a pair of goals is coupled to the panel proximate to a respective opposing end of the panel and equally distant from opposing sides of the panel. A disc and a set of figurines are selectively positionable upon an upper surface of the panel. Each figurine comprises a base that is configured to be grasped in a hand of a user, positioning the user to tilt the figurine and to impart a downward force upon a circumference of the disc to selectively propel the disc toward a respective goal and another figurine.

13 Claims, 5 Drawing Sheets

SOCCER BOARD GAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to board game assemblies and more particularly pertains to a new board game assembly for playing a soccer themed game.

(2) Description of Related Art Including Information Disclosed Under 37 CFR 1.97 and 1.98

The prior art relates to board game assemblies. Prior art soccer themed game assemblies may comprise a set of dice, marbles, figurines coupled to rotatable rods, figurines with a movable leg, slidable figurines that strike a disc, or disc shaped sliders representing players.

BRIEF SUMMARY OF THE INVENTION

An embodiment of the disclosure meets the needs presented above by generally comprising a panel that is representative of a soccer field. Each of a pair of goals is coupled to the panel proximate to a respective opposing end of the panel and equally distant from opposing sides of the panel. A disc and a set of figurines are selectively positionable upon an upper surface of the panel. Each figurine comprises a base that is configured to be grasped in a hand of a user, positioning the user to tilt the figurine and to impart a downward force upon a circumference of the disc to selectively propel the disc toward a respective goal and another figurine.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
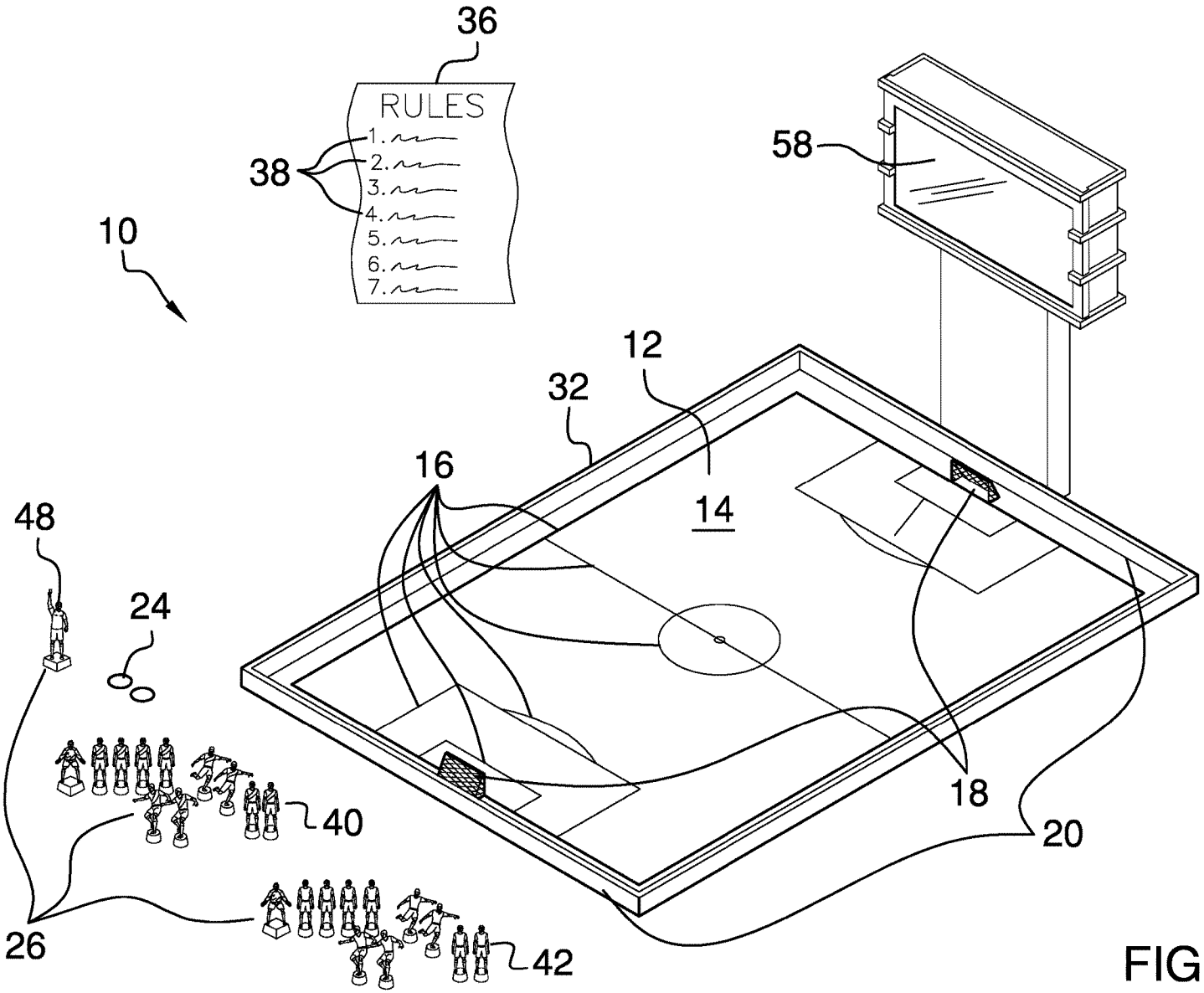
FIG. 1 is an isometric perspective view of a soccer board game assembly according to an embodiment of the disclosure.
Figure 2:
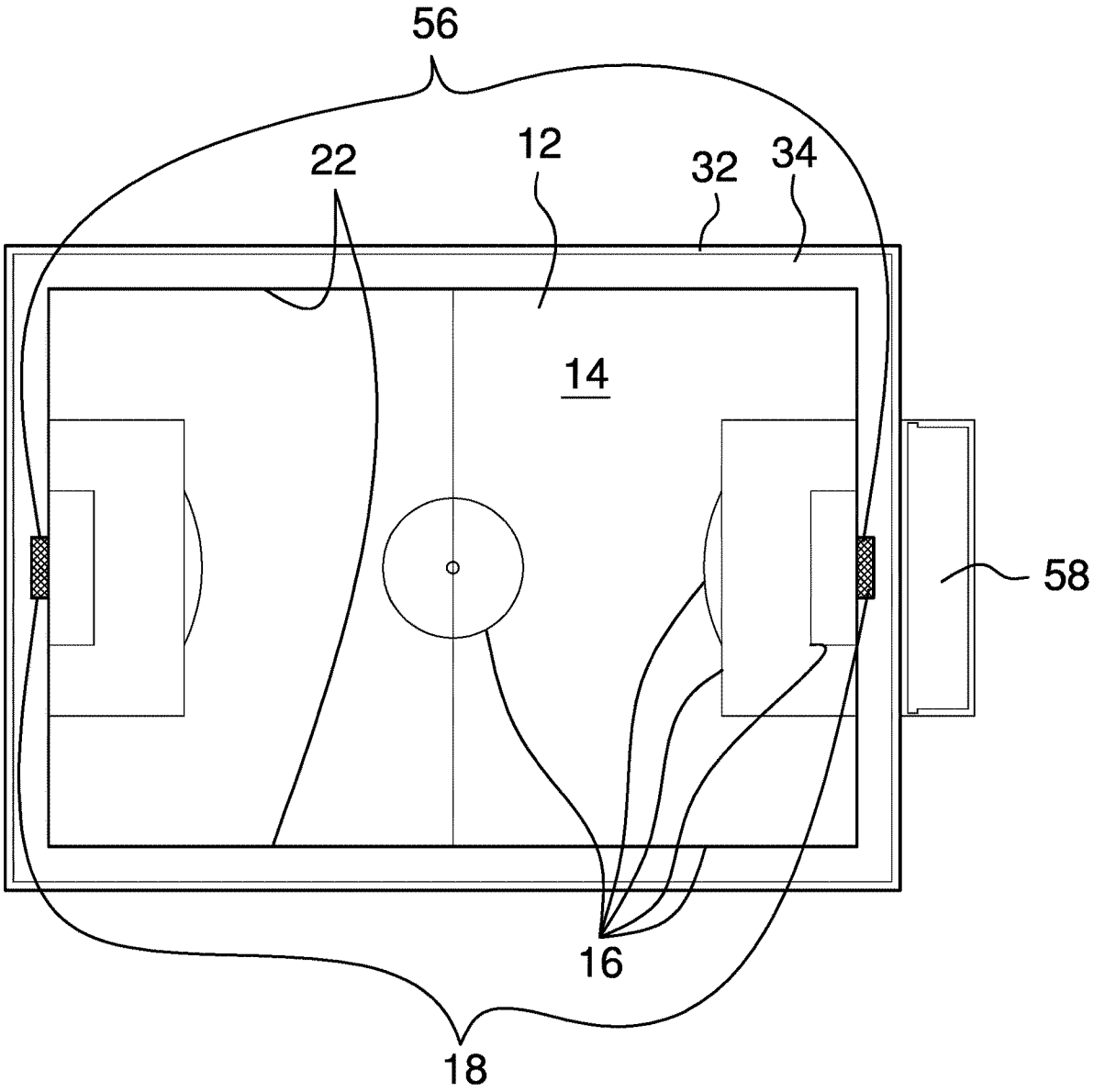
FIG. 2 is a top view of an embodiment of the disclosure.

With reference now to the drawings, and in particular to FIGS. 1 through 6 thereof, a new board game assembly embodying the principles and concepts of an embodiment of the disclosure and generally designated by the reference numeral 10 will be described.

As best illustrated in FIGS. 1 through 6, the soccer board game assembly 10 generally comprises a panel 12 that is representative of a soccer field. The panel 12 has an upper surface 14 that is colored green so that the upper surface 14 mimics at least one of grass and artificial turf. A set of lines 16 is coupled to the upper surface 14 of the panel 12 so that the panel 12 mimics a regulation soccer field.

Each of a pair of goals 18 is coupled to the panel 12 proximate to a respective opposing end 20 of the panel 12 and equally distant from opposing sides 22 of the panel 12. The goals 18 comprises at least one of mesh and netting.

A disc 24 and a set of figurines 26 are selectively positionable upon the upper surface 14 of the panel 12. Each figurine 26 comprises a base 28 that is configured to be grasped in a hand of a user, positioning the user to tilt the figurine 26 and to impart a downward force upon a circumference 30 of the disc 24 to selectively propel the disc 24 toward a respective goal 18 and another figurine 26. The present invention also anticipates the user utilizing the base 28 to strike the disc 24 to impart motion to the disc 24.

A wall 32 that is coupled to and extends annularly around a perimeter 34 of the panel 12 is configured to retain the disc 24 upon the panel 12. An instruction 36 is provided that comprises a set of rules 38 to play a soccer themed game upon the panel 12 using the set of figurines 26 and the disc 24.

Figure 3:
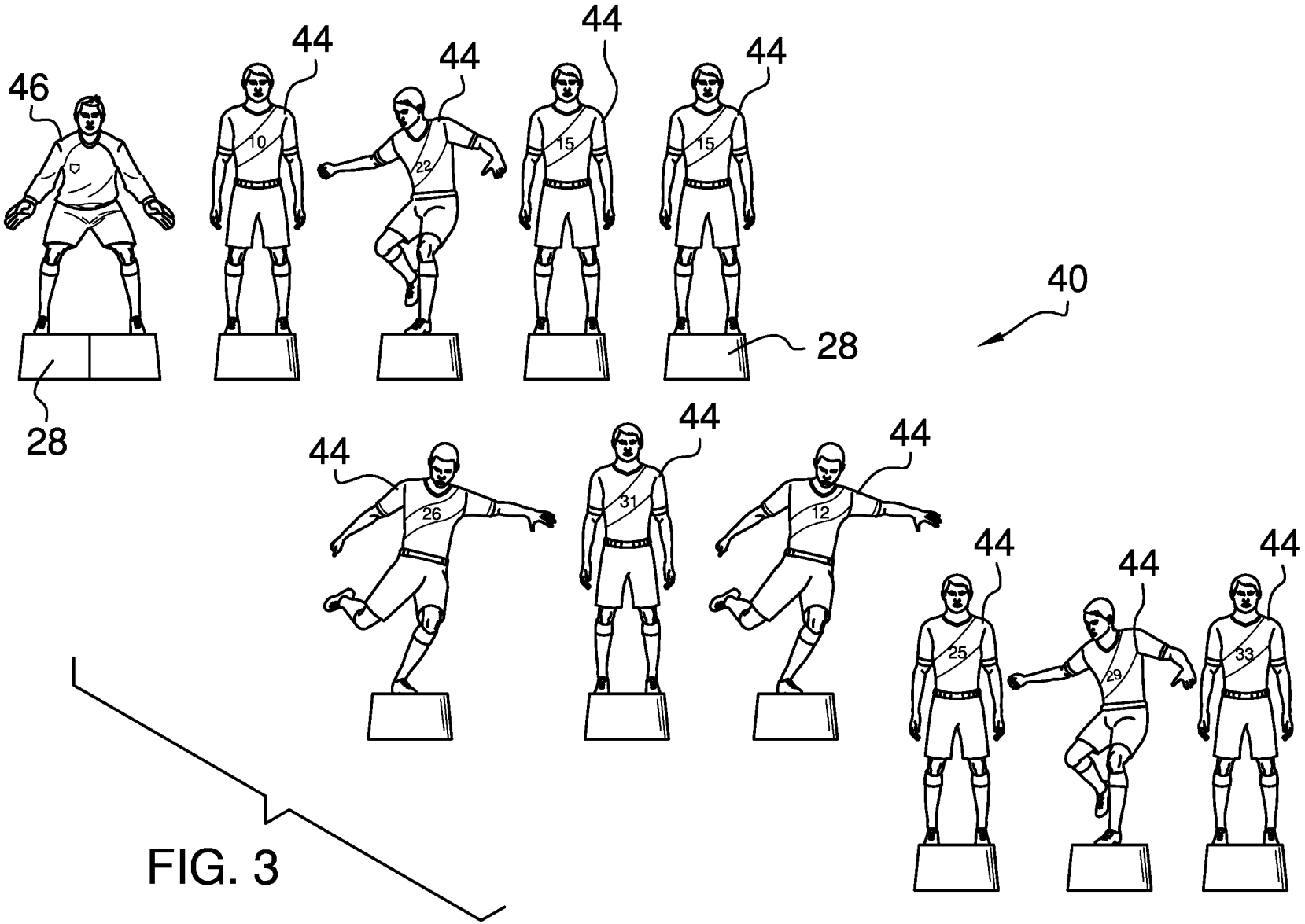
FIG. 3 is a front view of an embodiment of the disclosure.
Figure 5:
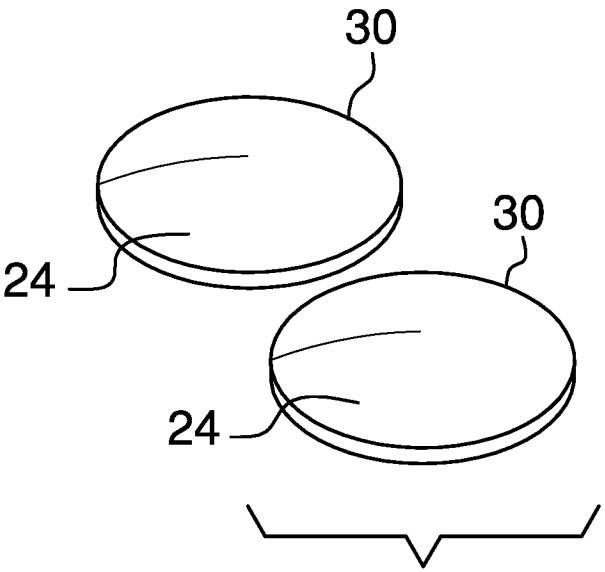
FIG. 5 is a detail view of an embodiment of the disclosure.

The set of figurines 26 comprises a first team 40 and a second team 42. The first team 40 and the second team 42 are distinguishable by color. For example, the first team 40 and the second team 42 might be blue and green, respectively, or each may be colored so as to represent a professional soccer team. Each of the first team 40 and the second team 42 comprises ten players 44 and one goalie 46. The players 44 may have a variety of poses, as shown in FIG. 3.

The bases 28 of the players 44 may be cylindrically shaped, or alternatively shaped, such as, but not limited to, ovally shaped, squarely shaped, and the like. The bases 28 of the goalies 46 may be rectangularly box shaped, or alternatively shaped, such as, but not limited to, ovally shaped, cylindrically shaped, and the like. The set of figurines 26 also may comprise a referee 48. The base 28 of the referee 48 may be rectangularly box shaped, or alternatively shaped, such as, but not limited to, ovally shaped, cylindrically shaped, and the like.

Figure 4:
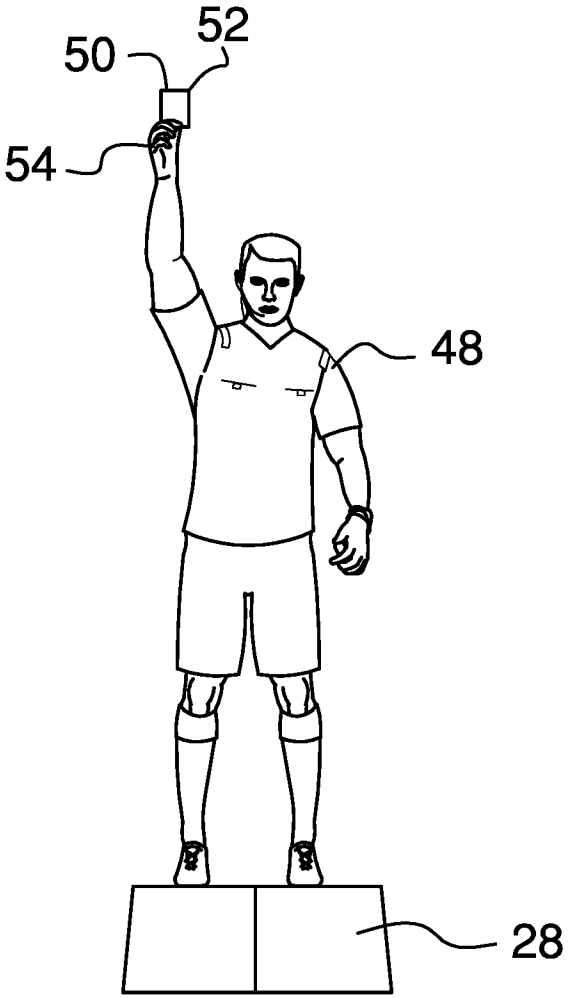
FIG. 4 is a detail view of an embodiment of the disclosure.
Figure 6:
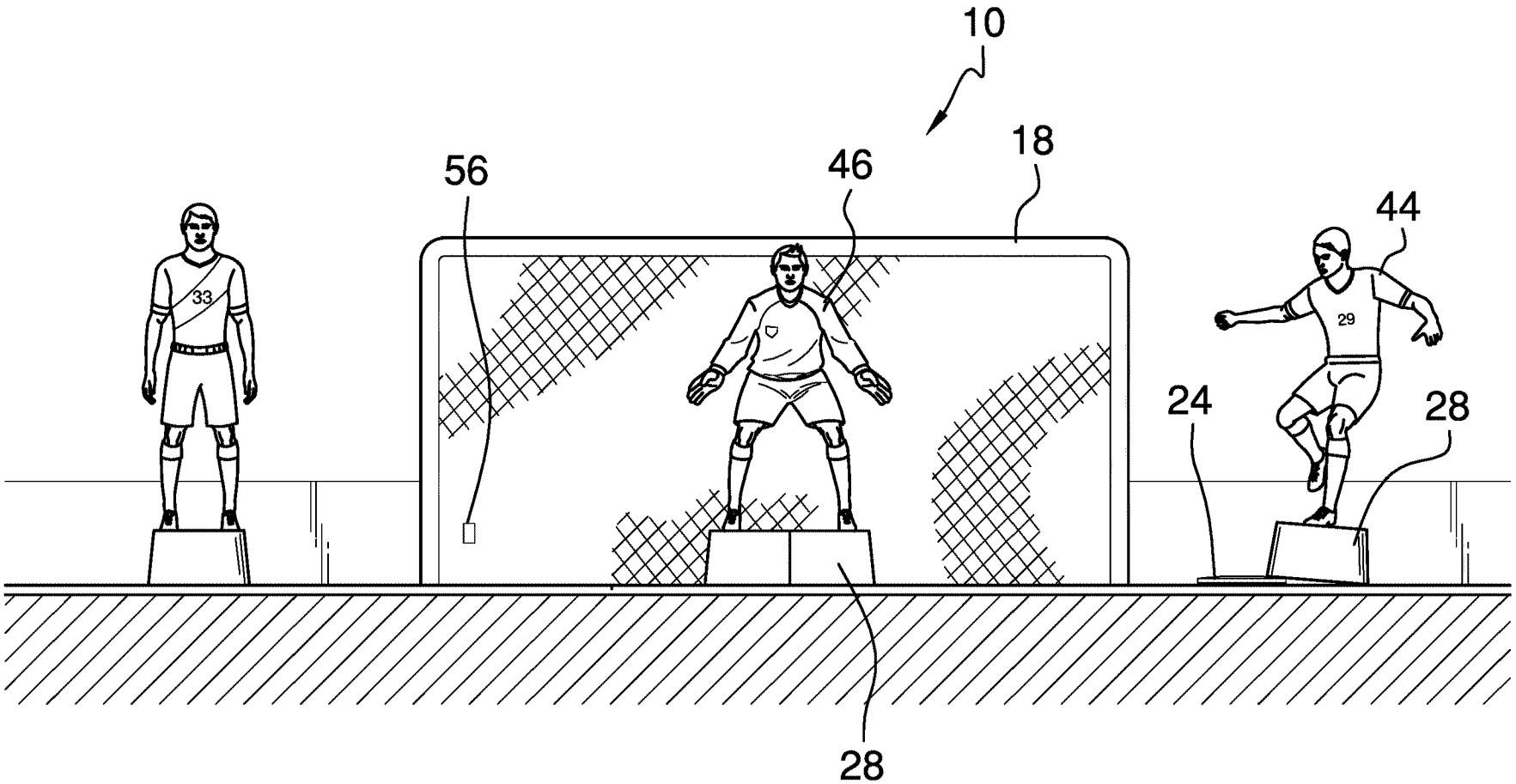
FIG. 6 is an in-use view of an embodiment of the disclosure.

The assembly 10 also may comprise a yellow card 50 and a red card 52, which are selectively couplable to an upraised hand 54 of the referee 48, as shown in FIG. 4, and thus configured to indicate a caution and a dismissal, respectively.

The assembly 10 also may comprise a pair of detectors 56 and a display 58. Each detector 56 is coupled to the panel 12 proximate to a respective goal 18. The detector 56 is configured to detect entry of the disc 24 into the respective goal 18. The display 58 is coupled to the perimeter 34 of the panel 12 and is operationally coupled to the pair of detectors 56. A respective detector 56 is positioned to signal the display 58 upon entry of the disc 24 into an associated goal 18, wherein the display 58 is configured to illuminate to indicate a goal.

In use, the disc 24 and the set of figurines 26 are positioned on the upper surface 14 of the panel 12. A first game participant assigned the first team 40 propels the disc 24 toward the goal 18 of a second game participant, or toward another player 44 of the first team 40, by grasping the base 28 of a player 44 of the first team 40, tilting the figurine 26, and then bringing the base 28 down upon the circumference 30 of the disc 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A soccer board game assembly comprising:

a panel representative of a soccer field;

a pair of goals, each goal being coupled to the panel proximate to a respective opposing end of the panel and equally distant from opposing sides of the panel;

a disc selectively positionable upon an upper surface of the panel; and a set of figurines selectively positionable upon the upper surface, each figurine comprising a base wherein the base is configured for grasping in a hand of a user positioning the user for tilting the figurine and imparting a downward force upon a circumference of the disc for selectively propelling the disc toward a respective goal and another figurine, the set of figurines comprising a first team and a second team, each of the first team and the second team comprising ten players and one goalie, the bases of the goalies being rectangularly box shaped, the base of each goalie having a pair of straight forwardly facing sides having a junction therebetween centered in front of the goalie such that the straight forwardly facing straight edges are positioned to deflect the disc laterally away from the goalie when the disc strikes the base coming from a direction in front of the goalie.

2. The assembly of claim 1, further including the upper surface being colored green such that the upper surface mimics at least one of grass and artificial turf.

3. The assembly of claim 2, further including a set of lines coupled to the upper surface such that the panel mimics a regulation soccer field.

4. The assembly of claim 1, further including the goals comprising at least one of mesh and netting.

5. The assembly of claim 1, further comprising the first team and the second team being distinguishable by color.

6. The assembly of claim 1, further including the bases of the players being cylindrically shaped.

7. The assembly of claim 1, further including the set of figurines comprising a referee.

8. The assembly of claim 7, further including the base of the referee being rectangularly box shaped.

9. The assembly of claim 7, further including a yellow card and a red card, the yellow card and the red card being selectively couplable to an upraised hand of the referee wherein the yellow card and the red card are configured for indicating a caution and a dismissal, respectively.

10. The assembly of claim 1, further including a wall coupled to and extending annularly around a perimeter of the panel wherein the wall is configured for retaining the disc upon the panel.

11. The assembly of claim 1, further comprising:

a pair of detectors, each detector being coupled to the panel proximate to a respective goal wherein the detector is configured for detecting entry of the disc into the respective goal; and a display coupled to the perimeter of the panel, the display being operationally coupled to the pair of detectors such that a respective detector is positioned for signaling the display upon entry of the disc into an associated goal wherein the display is configured for illuminating for indicating a goal.

12. The assembly of claim 1, further including an instruction comprising a set of rules for playing a soccer themed game upon the panel using the set of figurines and the disc.

13. A soccer board game assembly comprising:

a panel representative of a soccer field, the panel having an upper surface, the upper surface being colored green such that the upper surface mimics at least one of grass and artificial turf;

a set of lines coupled to the upper surface of the panel such that the panel mimics a regulation soccer field;

a pair of goals, each goal being coupled to the panel proximate to a respective opposing end of the panel and equally distant from opposing sides of the panel, the goals comprising at least one of mesh and netting;

a disc selectively positionable upon the upper surface of the panel;

a set of figurines selectively positionable upon the upper surface, each figurine comprising a base wherein the base is configured for grasping in a hand of a user positioning the user for tilting the figurine and imparting a downward force upon a circumference of the disc for selectively propelling the disc toward a respective goal and another figurine, the set of figurines comprising a first team and a second team, the first team and the second team being distinguishable by color, each of the first team and the second team comprising ten players and one goalie, the bases of the players being cylindrically shaped, the bases of the goalies being rectangularly box shaped, the set of figurines comprising a referee, the base of the referee being rectangularly box shaped, the base of each goalie having a pair of straight forwardly facing sides having a junction therebetween centered in front of the goalie such that the straight forwardly facing straight edges are positioned to deflect the disc laterally away from the goalie when the disc strikes the base coming from a direction in front of the goalie;

a yellow card and a red card, the yellow card and the red card being selectively couplable to an upraised hand of the referee wherein the yellow card and the red card are configured for indicating a caution and a dismissal, respectively;

a wall coupled to and extending annularly around a perimeter of the panel wherein the wall is configured for retaining the disc upon the panel;

a pair of detectors, each detector being coupled to the panel proximate to a respective goal wherein the detector is configured for detecting entry of the disc into the respective goal;

a display coupled to the perimeter of the panel, the display being operationally coupled to the pair of detectors such that a respective detector is positioned for signaling the display upon entry of the disc into an associated goal wherein the display is configured for illuminating for indicating a goal; and an instruction comprising a set of rules for playing a soccer themed game upon the panel using the set of figurines and the disc.

* * * * *